US007874447B2

(12) United States Patent
Schmidtner et al.

(10) Patent No.: US 7,874,447 B2
(45) **Date of Patent: *Jan. 25, 2011**

(54) RECLOSABLE CUP LID WITH SLIDING MEMBER AND SCALLOPED TRACK

(75) Inventors: Alois A. Schmidtner, Hellerton, PA (US); Jonathan E. Rush, Mount Bethel, PA (US)

(73) Assignee: Dixie Consumer Products LLC, Atlanta, GA (US)

( * ) Notice: Subject to any disclaimer, the term of this patent is extended or adjusted under 35 U.S.C. 154(b) by 1265 days.

This patent is subject to a terminal disclaimer.

(21) Appl. No.: 11/402,426

(22) Filed: Apr. 12, 2006

(65) Prior Publication Data

US 2006/0261068 A1 Nov. 23, 2006

Related U.S. Application Data

(63) Continuation-in-part of application No. 11/244,133, filed on Oct. 5, 2005.

(60) Provisional application No. 60/617,123, filed on Oct. 8, 2004.

(51) Int. Cl.

| | |
|---|---|
| ***B65D 51/18*** | (2006.01) |
| ***B65D 51/16*** | (2006.01) |
| ***B65D 3/00*** | (2006.01) |
| ***A47G 19/22*** | (2006.01) |

(52) U.S. Cl. ..... 220/254.9; 220/713; 220/714; 220/715; 220/367.1; 229/404; 229/906.1

(58) Field of Classification Search ..... 220/367.1, 220/713–715, 711, 380, 719, 350, 351, 345.2–345.4, 220/254.9, 254.5, 254.4, 254.1, 345.1; 222/481; 229/404, 906.1

See application file for complete search history.

(56) References Cited

U.S. PATENT DOCUMENTS

| | | | |
|---|---|---|---|
| 581,293 | A | 4/1897 | Leggett |
| 949,974 | A | 2/1910 | Cibulka |

(Continued)

FOREIGN PATENT DOCUMENTS

| | | |
|---|---|---|
| CA | 2584589 | 10/2007 |

(Continued)

OTHER PUBLICATIONS

International Search Report and Written Opinion for PCT/US2008/058863 mailed Jan. 23, 2009.

(Continued)

*Primary Examiner*—Robin Hylton

(57) ABSTRACT

A reclosable cup lid thermoformed from a polymeric material includes a domed member and a closure panel. The thermoformed domed member is provided with a sidewall and a top wall, the top wall having upper and lower surfaces and a drinking aperture at a periphery of the top wall. The top wall further defines a pair of engagement tracks depending from the lower surface of the top wall and also defines a post aperture disposed inwardly with respect to the drinking aperture. The closure panel has opposed engagement edges, an upper surface provided with a post projecting upwardly therefrom, and a drinking aperture sealing area. As assembled, the domed member and closure panel are configured such that the opposed engagement edges of the closure panel are slidingly mounted in the engagement tracks for generally radial displacement.

18 Claims, 12 Drawing Sheets

U.S. PATENT DOCUMENTS

| | | | | |
|---|---|---|---|---|
| 1,433,544 | A | 10/1922 | Gibbs | |
| 1,765,284 | A | 6/1930 | Prosnitz | |
| 1,888,363 | A | 11/1932 | Tannewitz | |
| 2,304,214 | A | 12/1942 | Straub | |
| D144,649 | S | 5/1946 | Tobler | |
| 2,492,846 | A | 12/1949 | Coyle et al. | |
| 2,665,038 | A | 1/1954 | Fowler | |
| 3,355,069 | A | 11/1967 | Miles | |
| 3,363,798 | A | 1/1968 | Garangiotis | |
| 3,938,690 | A | 2/1976 | Butler | |
| 4,057,167 | A | 11/1977 | Lee | |
| 4,099,642 | A | 7/1978 | Nergard | |
| 4,127,212 | A | 11/1978 | Waterbury | |
| 4,170,724 | A | 10/1979 | Waterbury | |
| 4,187,954 | A | 2/1980 | Striggow | |
| 4,201,320 | A | 5/1980 | Eppenbach | |
| 4,243,156 | A | 1/1981 | Lobbestael | |
| 4,434,906 | A | 3/1984 | Florczyk et al. | |
| 4,441,624 | A | 4/1984 | Sokolowski | |
| 4,570,817 | A | 2/1986 | Hambleton et al. | |
| 4,579,245 | A | 4/1986 | Narushko | |
| 4,582,214 | A | 4/1986 | Dart et al. | |
| 4,589,569 | A | 5/1986 | Clements | |
| D286,026 | S | 10/1986 | Rayner | |
| 4,615,459 | A | 10/1986 | Clements | |
| 4,629,088 | A | 12/1986 | Durgin | |
| 4,746,032 | A | 5/1988 | Huang | |
| 4,749,099 | A | 6/1988 | Davis et al. | |
| D296,523 | S | 7/1988 | Corno et al. | |
| 4,756,440 | A | 7/1988 | Gartner | |
| D299,010 | S | 12/1988 | Wall | |
| 4,819,829 | A | 4/1989 | Rosten et al. | |
| 4,898,299 | A | 2/1990 | Herbst et al. | |
| 4,915,250 | A | 4/1990 | Hayes, Jr. et al. | |
| 4,986,437 | A | 1/1991 | Farmer | |
| 4,989,746 | A | 2/1991 | Pierce | |
| 5,025,945 | A | 6/1991 | Lyon | |
| 5,065,880 | A | 11/1991 | Horner | |
| D323,619 | S | 2/1992 | Wilfong, Jr. et al. | |
| 5,086,941 | A | 2/1992 | English et al. | |
| D329,604 | S | 9/1992 | Kuczer | |
| 5,148,936 | A | 9/1992 | DeGrow | |
| 5,186,347 | A | 2/1993 | Freeman et al. | |
| 5,253,781 | A | 10/1993 | Van Melle et al. | |
| 5,294,014 | A | 3/1994 | Wyatt et al. | |
| 5,299,604 | A | 4/1994 | Pierce | |
| 5,363,983 | A | 11/1994 | Proshan | |
| 5,392,949 | A | 2/1995 | McKenna | |
| 5,421,472 | A | 6/1995 | Beckertgis | |
| 5,449,085 | A | 9/1995 | Brun, Jr. | |
| 5,460,286 | A | 10/1995 | Rush et al. | |
| 5,462,189 | A | 10/1995 | Pierce | |
| 5,470,817 | A | 11/1995 | Nakamura et al. | |
| D368,624 | S | 4/1996 | Forrer | |
| 5,538,157 | A | 7/1996 | Proshan | |
| 5,657,898 | A | 8/1997 | Portman et al. | |
| D385,748 | S | 11/1997 | Iodice et al. | |
| 5,938,062 | A | 8/1999 | Paramski | |
| D417,845 | S | 12/1999 | Sadlier et al. | |
| 6,003,711 | A | 12/1999 | Bilewitz | |
| 6,216,904 | B1 | 4/2001 | Cagan | |
| 6,220,470 | B1 | 4/2001 | McHenry et al. | |
| 6,354,454 | B1 | 3/2002 | Wong | |
| 6,419,112 | B1 | 7/2002 | Bruce et al. | |
| 6,439,442 | B1 | 8/2002 | Markert et al. | |
| D476,567 | S | 7/2003 | Weiss et al. | |
| D477,532 | S | 7/2003 | Wong | |
| D489,260 | S | 5/2004 | Smith et al. | |
| 6,732,875 | B2 | 5/2004 | Smith et al. | |
| 6,752,287 | B1 | 6/2004 | Lin | |
| 6,824,003 | B1 * | 11/2004 | Wong | 220/254.9 |
| D500,428 | S | 1/2005 | Ward et al. | |
| 6,883,677 | B2 | 4/2005 | Goeking et al. | |
| 6,929,143 | B2 | 8/2005 | Mazzarolo | |
| 6,976,577 | B2 | 12/2005 | Devine | |
| D516,424 | S | 3/2006 | Schweigert et al. | |
| D531,033 | S | 10/2006 | Schmidtner et al. | |
| D533,779 | S | 12/2006 | Schmidtner et al. | |
| 7,156,251 | B2 | 1/2007 | Smith et al. | |
| 7,159,732 | B2 | 1/2007 | Smith et al. | |
| 7,246,715 | B2 * | 7/2007 | Smith et al. | 220/253 |
| 7,275,653 | B2 | 10/2007 | Tedford, Jr. | |
| 2003/0089713 | A1 | 5/2003 | Belt et al. | |
| 2005/0103787 | A1 | 5/2005 | Simcovitch | |
| 2005/0261771 | A1 * | 11/2005 | Paul et al. | 623/17.11 |
| 2006/0000832 | A1 | 1/2006 | Smith et al. | |
| 2006/0071008 | A1 | 4/2006 | Sadlier | |
| 2006/0081633 | A1 * | 4/2006 | Schmidtner et al. | 220/254.9 |
| 2006/0201945 | A1 | 9/2006 | Tedford, Jr. | |
| 2006/0243734 | A1 | 11/2006 | Tedford, Jr. | |
| 2007/0278228 | A1 | 12/2007 | Wong | |

FOREIGN PATENT DOCUMENTS

| | | | |
|---|---|---|---|
| EP | 1247752 | B1 | 2/2004 |
| EP | 1484261 | | 12/2004 |
| FR | 2690671 | | 11/1993 |
| FR | 2780385 | | 12/1999 |
| GB | 2243149 | A | 10/1991 |
| GB | 2416343 | A | 1/2006 |
| GB | 2426970 | A | 12/2006 |
| WO | WO 2006/009450 | A1 | 1/2006 |
| WO | WO 2007/052014 | A1 | 5/2007 |
| WO | WO 2008/021523 | A2 | 2/2008 |

OTHER PUBLICATIONS

J.L. Throne, Thermoforming, published 1987 by Coulthard; pp. 21-29.

PCT International Search Report, Jul. 15, 2008.

* cited by examiner

RECLOSABLE CUP LID WITH SLIDING MEMBER AND SCALLOPED TRACK

PRIORITY CLAIM

This application is a continuation-in-part of U.S. application Ser. No. 11/244,133, filed Oct. 5, 2005, which claims priority to U.S. Provisional Application Ser. No. 60/617,123, filed Oct. 8, 2004. Each of these applications is incorporated herein in its entirety by this reference.

TECHNICAL FIELD

The present invention relates generally to cup lids and, more particularly, to a disposable cup lid with a drinking aperture and a closure panel displaceable along a generally radial direction between an open position wherein the aperture communicates with the interior of the lid and a closed position where the closure panel covers the aperture to reduce or substantially prevent spillage in use.

BACKGROUND

Substantial variations are known in the configuration of reclosable lids in general as evidenced by the following: U.S. Pat. No. 581,293 entitled "Can Cover or the Like" of C. H. Leggett; U.S. Pat. No. 949,974 entitled "Closure for Cans" of G. A. Cibulka; U.S. Pat. No. 1,433,544 entitled "Sifter Can" of J. C. Gibbs; U.S. Pat. No. 1,765,284 entitled "Ink Well Closure" of L. B. Pronsnitz; U.S. Pat. No. 1,888,363 entitled "Inkwell" of C. E. Tannewitz; U.S. Pat. No. 2,492,846 entitled "Dispensing Container with Slide Closure" of J. Coyle et al.; U.S. Pat. No. 4,170,724 entitled "Vendable Reclosable Beverage Container" of Waterbury; U.S. Pat. No. 4,201,320 entitled "Measuring Dispenser" of Eppenbach; U.S. Pat. No. 4,434,906 entitled "Container Having Resealable Opening Means" of Florczyk et al.; U.S. Pat. No. 5,025,945 entitled "Beverage Container" of Lyon; U.S. Pat. No. 5,086,941 entitled "Dispenser Closure Assembly" of English et al.; U.S. Pat. No. 5,462,189 entitled "Resealable, Refillable Container System" of Pierce; U.S. Pat. No. 6,354,454 entitled "Bottle Cap" of Wong; and U.S. Pat. No. 6,439,442 entitled "Lid With a Slidable Dispensing Spout" of Markert et al. The disclosures of these aforementioned references are incorporated herein in their entireties by this reference.

Reclosable beverage lids or containers are seen in U.S. Pat. No. 4,749,099 entitled "Drink Preserver" of Davis et al.; U.S. Pat. No. 5,470,817 entitled "Slidable Reclosable Plastic Lid" of Hambleton et al.; and U.S. Pat. No. 4,127,212 entitled "Vendable Reclosable Beverage Container" of Waterbury, each of which is incorporated herein in its entirety by this reference. In Davis et al., a push-in tab is interconnected to a slide panel within a track formed in the metal top of the container. The push-in tab operates to tear a scored portion down into the top for exposing an opening whereby the slide panel can be moved over the opening to protect unused contents within the container. In Hambleton et al., a plastic container lid includes a main lid member and a slide member. The main lid member has supporting guideways between which the slide member is situated, and the guideways are angled relative to the plane of the main lid member so as to hold the slide member on the lid. An aperture is provided in the main lid and the slide member may cover the aperture. The slide member also includes a finger engageable portion. Waterbury is directed to a reclosable beverage container and provides a slidable cap mounted on an upper end of the container for movement over an opening in the lid. The cap cannot be removed from the lid.

The foregoing items are not generally suitable for the disposable lid/cup market where cost, storage, ease of manufacture and so forth are paramount.

With respect to disposable cup lids, closure panels have commonly been incorporated into the upper wall of a plastic lid, defined by scores such that the closure panel is ripped away from the adjacent parts of the cover along the scores and then folded back to open the drinking aperture of the lid; optionally secured in its open position to an upwardly projecting boss; and refolded to the brim to close the lid. These lids can be difficult to operate properly and often allow substantial spillage (especially troublesome with hot beverages) but have nevertheless enjoyed substantial commercial success, because, in part, they satisfy the demanding cost criteria of the disposable products market.

Domed hot cup lids, though not reclosable, have frequently displaced flatter lids with folding type closure panels because they are preferred by consumers and inherently control some spillage due to the fact that they add "splash height" to the cup above a contained beverage. Such lids as are generally known in the art include a dome shape formed from a thermoplastic polymeric material and have an opening for consuming a beverage when the lid is applied to a cup. Various shapes are provided to the lid and the openings and closures formed therein.

A reclosable dome lid is seen in U.S. Pat. No. 6,732,875 entitled "Reclosable Container Lid" of Smith et al. and U.S. Design Pat. No. D489,260 entitled "Reclosable Container Lid" of Smith et al., each of which is incorporated herein in its entirety by this reference. The lid includes a cover member and a rotatable disk member mounted in the cover of the lid. A post is located at a periphery of the lid to rotate the disk between open and closed positions beneath the drinking aperture. It is apparently necessary to incorporate features such as drain holes and the like due to the disk/lid geometry and the lid/disk combination appears to require redundant construction of the cover, that is, two layers over the whole top wall. Moreover, the cover features proposed prevent efficient nesting, increasing storage, packaging and transportation costs. The disclosed embodiments furthermore likely prevent stacking in a cup on lid arrangement when multiple beverages are purchased by a consumer; a drawback which might negate spillage gains by closing the drinking aperture.

A further example of reclosable cup lids is shown in U.S. Pat. No. 6,824,003 (incorporated herein by reference in its entirety) which purports to disclose a disposable and reclosable thermoformed lid. This lid has C-shaped rails in which a reclosable panel is snapped therein. The rails are tapered to allow snapping into the rails. It is believed that this lid is difficult, if not impossible, to manufacture due to the sharp edges formed in the C-shaped rails. Also, it is believed that this lid would not be stackable in an efficient manner.

Despite numerous options, existing and proposed disposable lids have one or more of the following drawbacks: difficulty of operation and ineffective resealing; ineffective spillage control; high material costs; inordinate storage, packaging and shipping costs; inability to stack in a cup on lid arrangement and so forth. By way of the present invention, such deficiencies in the art are overcome and there is provided a reclosable lid which is durable yet disposable, easy to use, stackable, effective for splash and spill prevention, easily manufactured out of a thermoplastic material with existing machinery, and low in cost.

SUMMARY OF INVENTION

The invention provides a disposable, reclosable cup lid thermoformed from a polymeric material and includes a lid member and a closure panel. The thermoformed lid member can be provided with a sidewall and a top wall, a top wall having upper and lower surfaces and a drinking aperture at a periphery of the top wall. The top wall can further define a pair of engagement tracks depending from the lower surface of the top wall and also define a post aperture disposed inwardly with respect to the drinking aperture. The closure panel can have opposed engagement edges having a distance, an upper surface provided with a post projecting upwardly therefrom, and a drinking aperture sealing area. The closure panel can be slideably inserted into the engagement tracks by application of a bending force to the lid member. As assembled, the lid member and closure panel can be configured such that the opposed engagement edges of the closure panel are slidingly inserted in the engagement tracks. In use, the cup lids are stackable so as to minimize space requirements. A method of making the lids is also provided herein.

Still other features and advantages of the present invention will become apparent from the discussion and drawings which follow.

BRIEF DESCRIPTION OF DRAWINGS

The invention is described in detail below in connection with the appended drawings wherein like numerals designate like parts and wherein.

DETAILED DESCRIPTION OF THE INVENTION

The invention is described in detail below for purposes of exemplification and illustration only. Modifications within the spirit and scope of the present invention, set forth in the appended claims, will be readily apparent to those of skill in the art. As used herein, terminology is given its ordinary meaning unless a more specific definition is given or the context indicates otherwise.

"Aspect ratio" refers to a ratio of an object length to an object width, for example a length of the closure panel to a width of the same closure panel.

"Generally radially" refers to a direction substantially parallel to or substantially along a diameter of the article.

Figure 7:
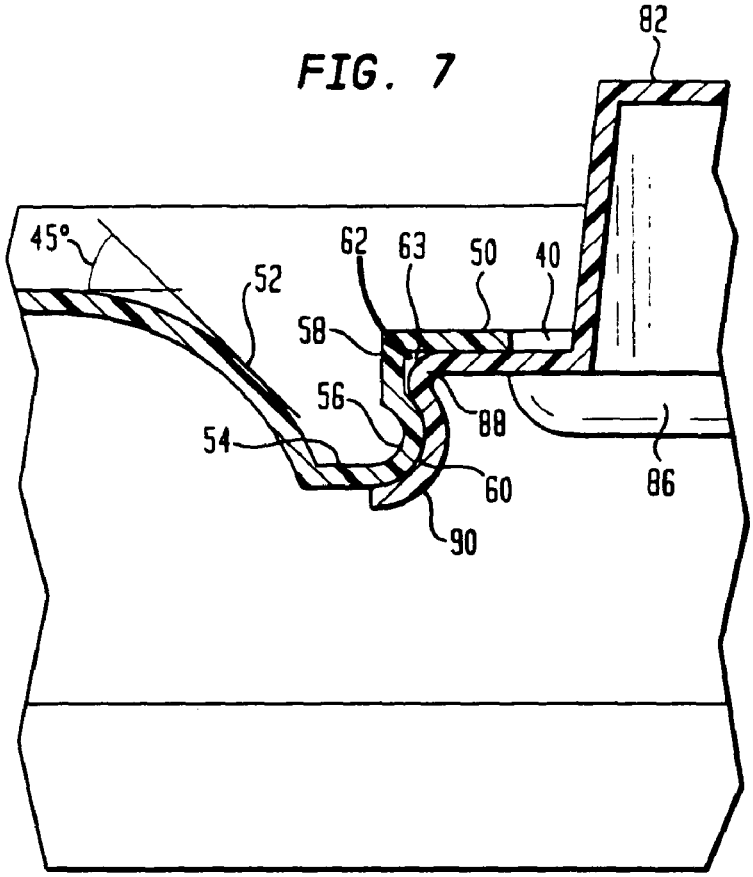
FIG. 7 is an enlarged partial sectional view illustrating detail of the engagement tracks and closure panel of the inventive lid.
Figure 7A:
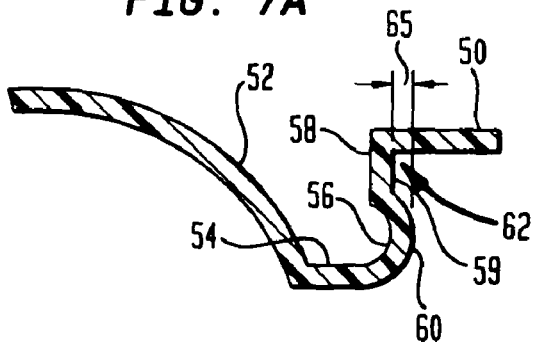
FIG. 7A is a detail showing the profile of an engagement track.
Figure 8:
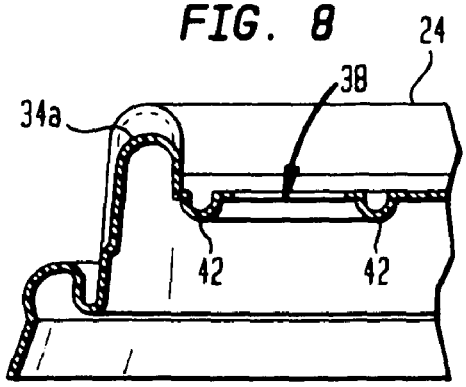
FIG. 8 is a view in partial section showing the sealing ridge around the drinking aperture.

"Modified S shape" refers to those profiles similar to an S shape, such as in the shape of a "5", such as in FIG. 7A. In various aspects, the bottom portion of the "5" can be rounded or square.

Figure 1:
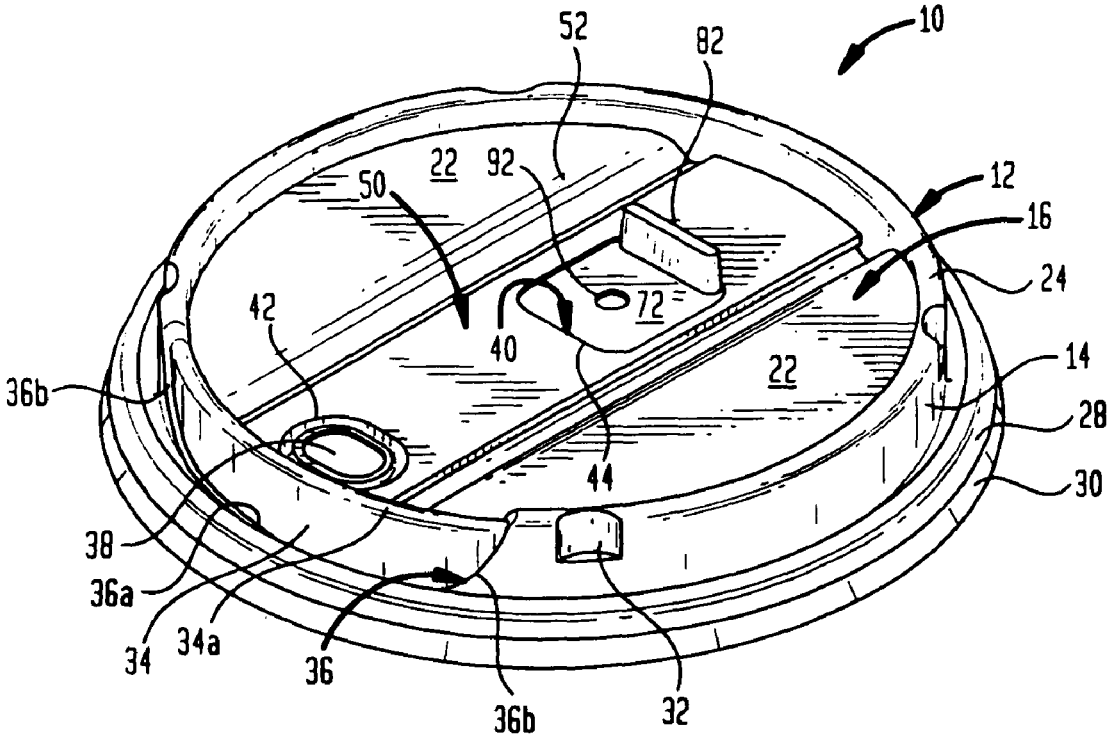
FIG. 1 is a perspective view of a two-piece reclosable beverage lid for a cup according to the present invention, wherein the closure panel is in an open position.
Figure 2:
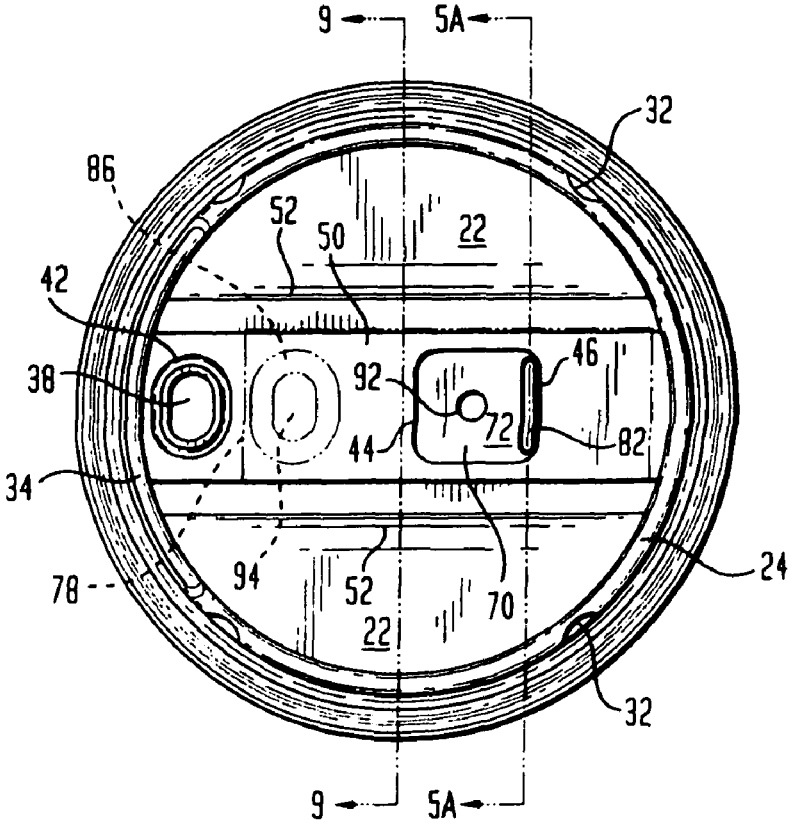
FIG. 2 is a top view of the lid shown in FIG. 1 with the closure panel in an open position panel.
Figure 3:
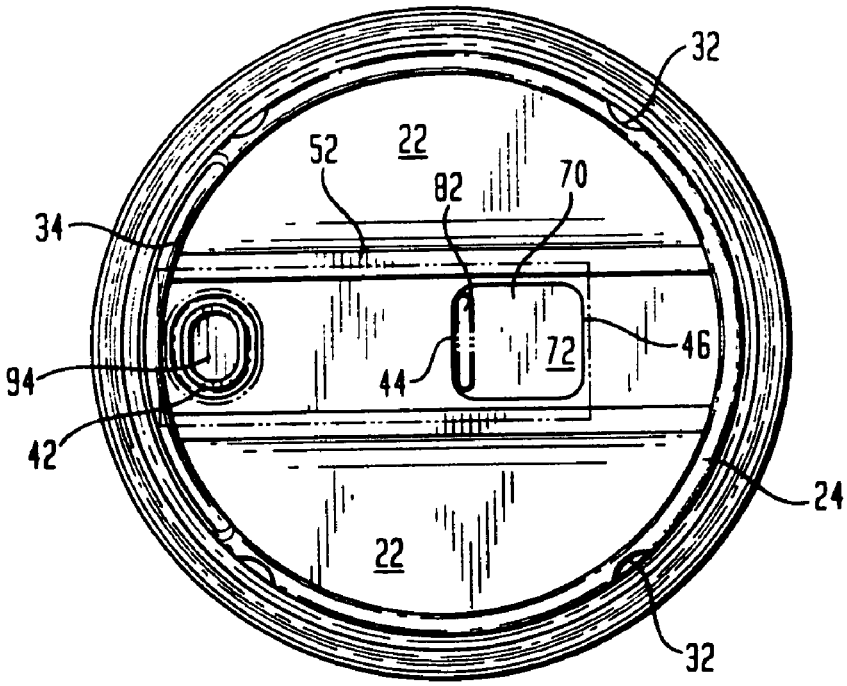
FIG. 3 is a top view of the lid shown in FIG. 1 with the closure panel in a closed position.
Figure 4:
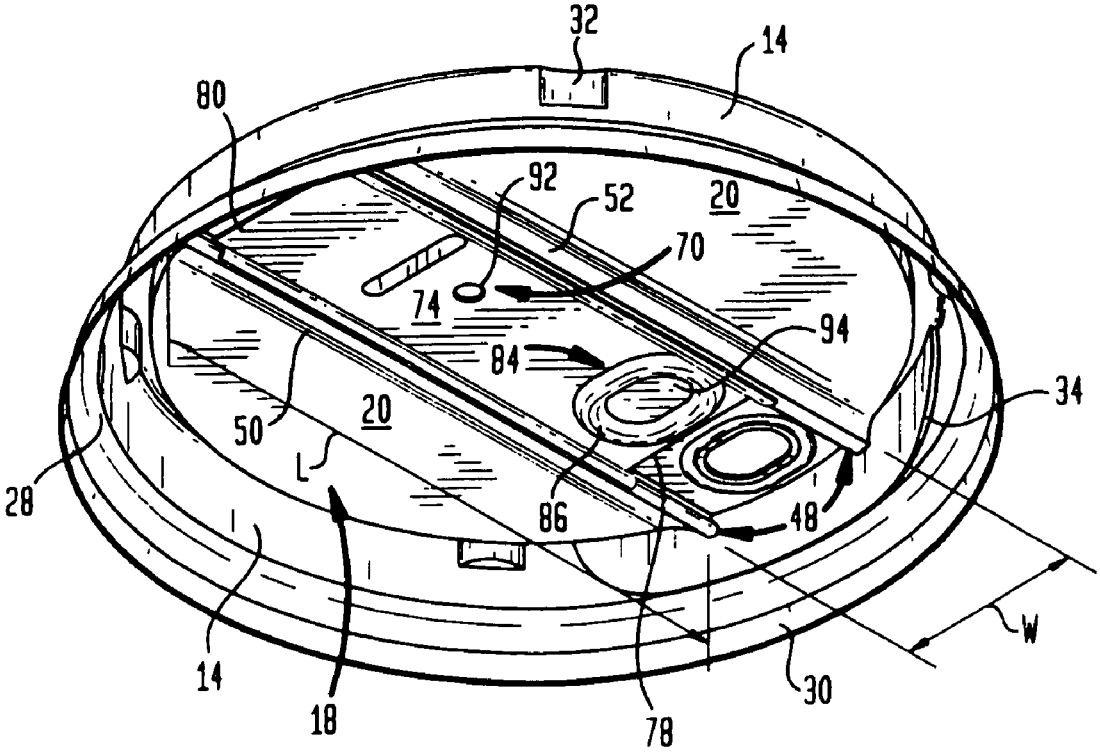
FIG. 4 is a bottom perspective view showing additional detail of the lid shown in FIG. 1.
Figure 5A:
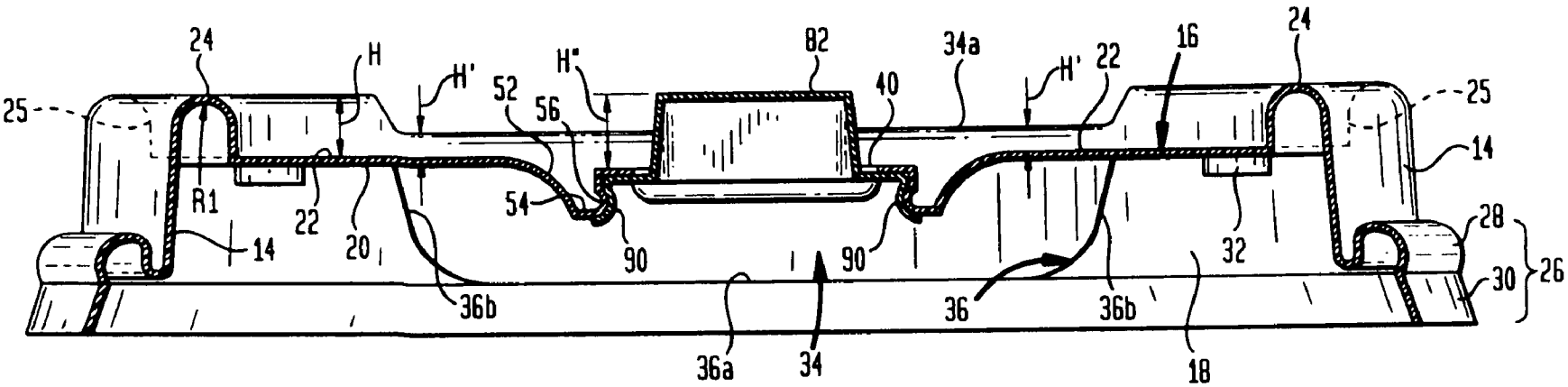
FIG. 5A is a cross-sectional view of the inventive lid taken along line 5-5 in FIG. 2 illustrating an interconnection of the lid member with the closure panel and a cup stacked on the lid.
Figure 5B:
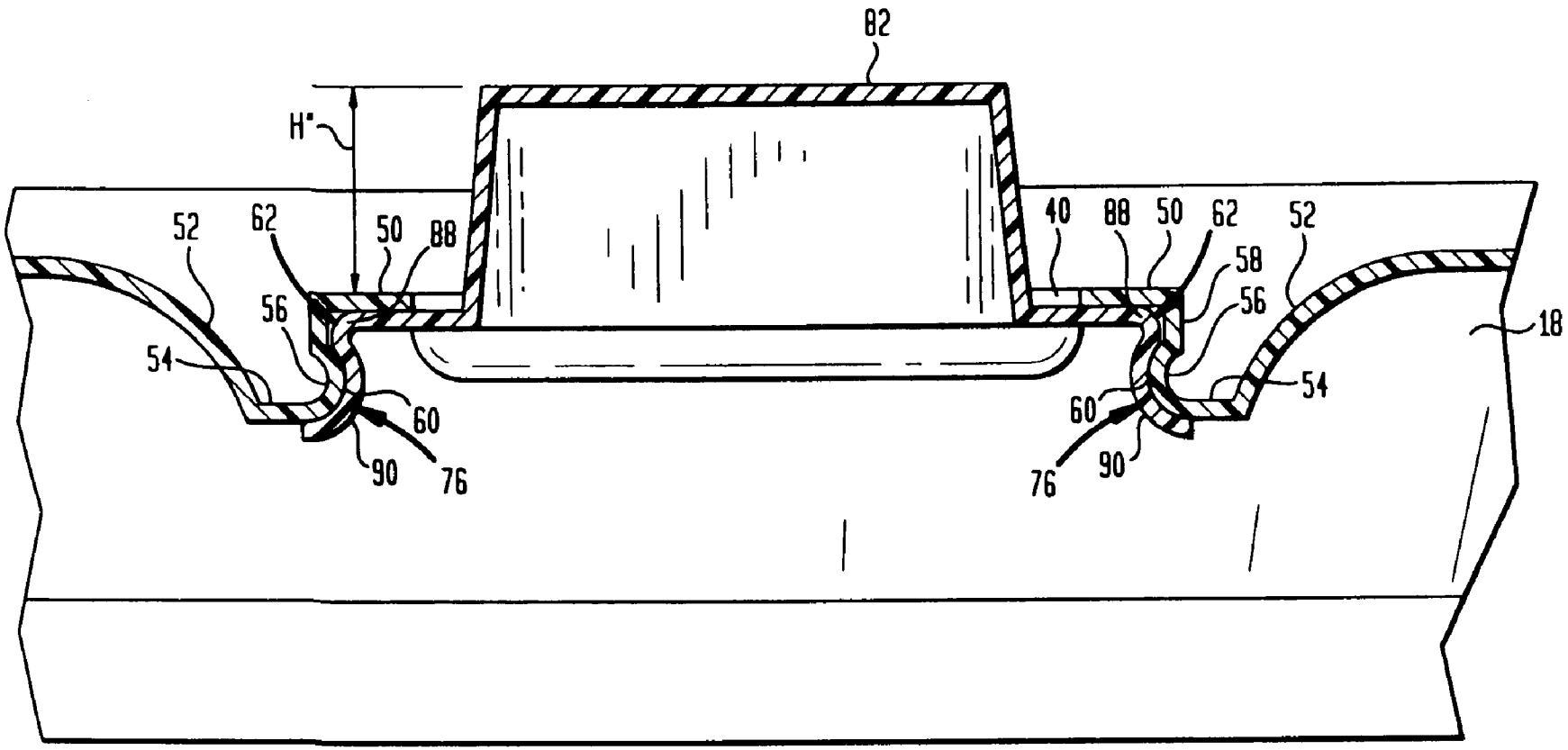
FIG. 5B is an enlarged detail of the interconnection of the domed member with the closure panel of FIG. 5A.
Figure 6A:
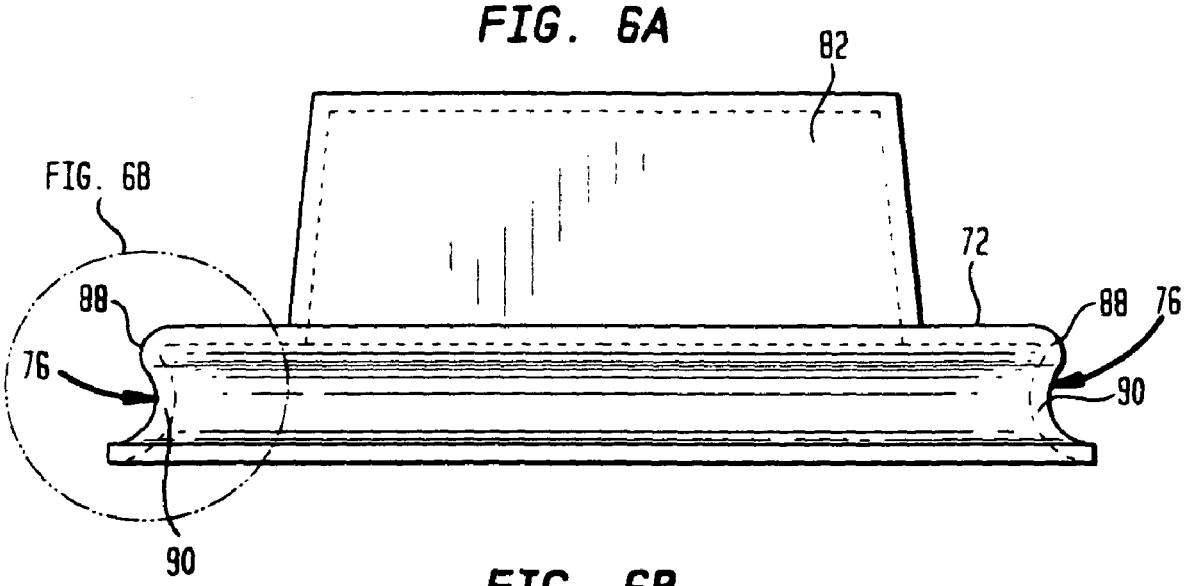
FIG. 6A is an end view of the closure panel.
Figure 6B:
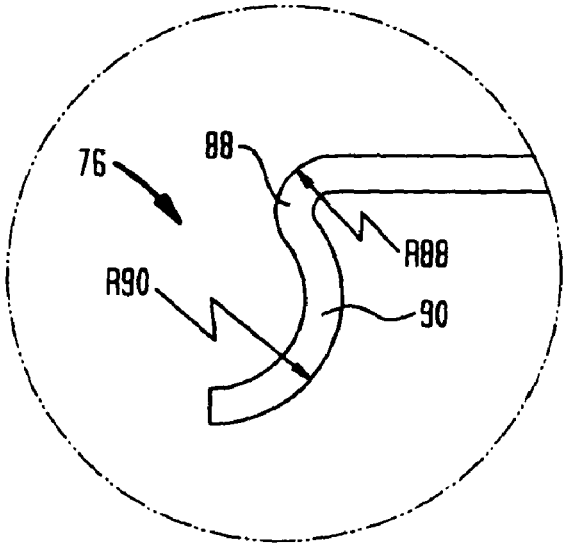
FIG. 6B is an enlarged detail of an edge of the closure panel as represented in FIG. 6A.
Figure 6C:
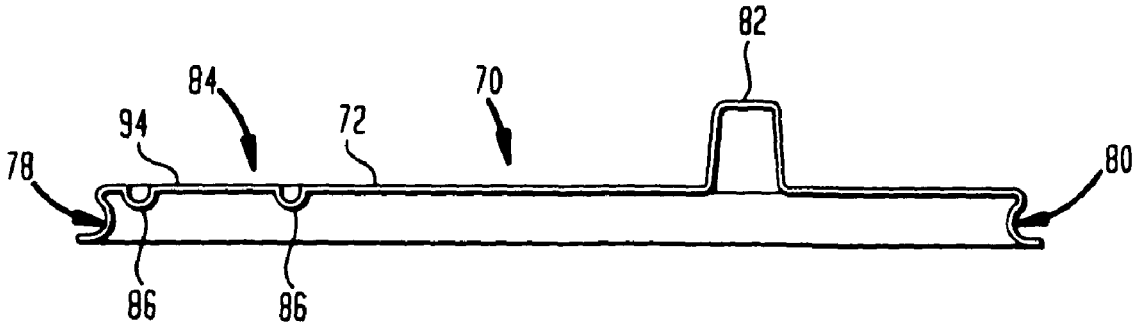
FIG. 6C is a view in section along the centerline of the closure panel showing the profile of the post and sealing groove.

"S-shaped profile" refers to a substantially S-shaped profile configuration as shown in the drawings, such as in FIGS. 5A and 5B, element 176. An S-shaped profile, whether modified or otherwise, is to be distinguished from the C-shaped track profile disclosed in U.S. Pat. No. 6,824,003, which disclosure is incorporated herein in its entirety by this reference.

"Undercut depth" refers to the distance that a recess extends laterally under (or over) a laterally projecting portion of the same thermoformed feature to define a lateral groove in the part. Undercuts are characterized by so-called "negative draft" discussed below. A part or feature has a positive draft if it is not undercut. When used in connection with undercuts of varying depth such as a scalloped undercut, "undercut depth" refers to undercut depth at the maximum lateral depth of the undercut. The undercut depth defines "undercut grooves" which are substantially coextensive with the engagement tracks.

Figure 12:
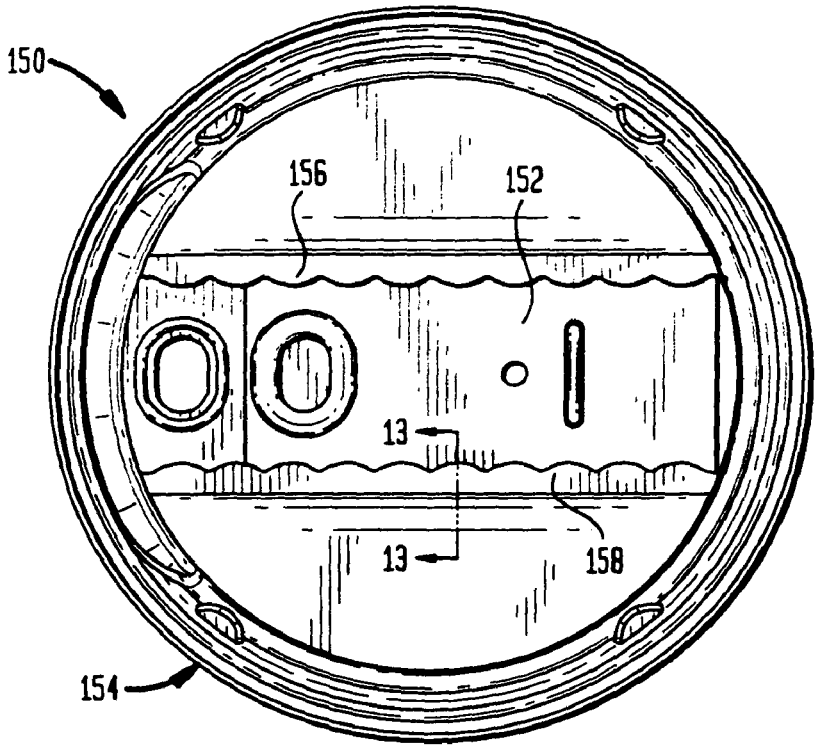
FIG. 12 is a bottom view showing an embodiment of the lid of the invention, wherein the dome has a pair of scalloped engagement tracks.

"Scalloped orientation" means in the form of a continuous series or circular elements or angular projections forming a border. A non-limiting example of a scalloped orientation is shown in FIG. 12, element 158.

"Disposable" means that the object is intended to be disposed of after one or, at most, a few uses.

"Substantially seals" means that there is no or substantially no spillage from the closure panel in the closed position.

In one form, the invention provides a reclosable and disposable lid for a cup, the lid being made from polymeric material and including: a) a thermoformed lid member provided with a sidewall and a top wall, the top wall having upper and lower surfaces and a drinking aperture at a periphery of the top wall, the top wall further defining a pair of engagement tracks depending from the inside of the top wall, the top wall also defining a post aperture disposed inwardly with respect to the drinking aperture; b) a thermoformed closure panel having opposed engagement edges along its length, an upper surface provided with a post, projecting upwardly therefrom, and a drinking aperture sealing area; c) the lid member and closure panel being configured such that the opposed engagement edges of the closure panel may be slidingly mounted in the engagement tracks on the underside of the top wall to reclosably seal the drinking aperture; wherein the post projects upwardly through the post aperture in the top wall, the closure panel being further characterized in that the post is displaceable in a generally radial direction in the engagement tracks to move between a sealing position wherein the sealing area of the closure member seals the drinking aperture and an open position wherein the drinking aperture is in communication with the interior of the lid member, provided further that the closure member substantially seals the post aperture when it is in the sealing position. The engagement tracks can substantially span the top wall of the lid member and are defined by generally parallel undercut grooves between lower portions of the engagement tracks and the lower surface of the top wall. In a suitable form, the engagement tracks can be configured to exhibit a scalloped orientation along a longitudinal direction.

In a further form, the closure panel can be substantially planar and the opposed engagement edges of the closure panel can be of substantially the same thickness as the closure panel and engage with the generally parallel engagement tracks. In a still further form, the opposed engagement edges of the closure panel are provided with thermoformed rims having a profile shaped to engage with the generally parallel engagement tracks in surface-to-surface contact over at least a portion of their respective profiles. In such cases, the opposed engagement rims of the closure panel can have a substantially S-shaped profile and the undercut grooves of the engagement tracks can have a matching S-shaped profile. Alternatively, the engagement rims of the closure panel or the undercut grooves of the engagement tracks can have a substantially S-shaped profile and the substantially S-shaped profile thereof can be matched with a modified S-shaped profile of corresponding undercut grooves or engagements rims such that upon mounting the closure member in the engagement tracks, the respective profiles of the rims and edges define an air gap between the engagement rims of the closure member and the engagement tracks over at least a portion of the profile of the mounted closure member in the engagement tracks. The closure panel can have chamfered longitudinal edges if so desired; a suitable angle of chamfer being from about 5 to about 15 degrees, or from about 8 to about 12 degrees.

The reclosable lid of the present invention can also include: a length of the closure panel of from about ½ to about ¾ the length of a diameter of the lid member; the length of the closure panel can be about ⅔ of the diameter of the lid member; as well as an area of the closure panel of from about 5 to about 25% of the area of the top wall. The area of the closure panel is typically not more than from about 25 to about 35% of the area of the top wall. The closure panel can have an aspect ratio (as defined herein) of at least about 1.5, or at least about 2.0 or at least about 3.

The upper surface of the top wall of the lid member generally defines a recess with a recess surface and a crown of height, H, above the recess surface thereabout, the recess and crown being adapted to receive the bottom of a cup, whereby a plurality of lidded cups are stackable with each other. To allow for stacking, the post projects upwardly from the surface of the recess at most about 1.25H and is disposed inwardly with respect thereto when the closure panel is secured in the engagement tracks. In a suitable form, the crown has a top wall with an arcuate upper surface for example, the top wall of the crown can have a radius of curvature of from about 0.025 to about 0.1". In a suitable form, the crown has a gapped portion of lower height above the recess surface radially aligned with the drinking aperture wherein the gapped portion of the crown has an arcuate upper surface. When provided, the gapped portion typically has a height of from about 0.75H to about 0.95H above the recess surface.

The closure panel may be provided with a vent hole positioned such that the post aperture communicates with the interior of the lid member when the closure panel is in the open position, thereby venting the interior in the open position to facilitate consumption of a beverage. Alternatively, a vent may be positioned elsewhere in the lid when venting is desirable.

A specific construction of the inventive lid can include: a) a unitary lid member provided with a sidewall and a top wall, i) the sidewall having at its lower portion a mounting groove configured to engage the brim of a cup and form a seal therewith; ii) the top wall also having an upper surface and a lower surface and defining a drinking aperture at a periphery of the top wall provided with a sealing ridge formed thereabout, the sealing ridge projecting downwardly from the upper surface, the top wall further defining a pair of generally parallel engagement tracks defined by generally parallel undercut grooves between the lower surface of the top wall and a lower portion of the engagement tracks, the top wall also having a post aperture disposed inwardly with respect to the drinking aperture; b) a thermoformed closure panel having an upper surface provided with a post projecting upwardly therefrom, a sealing groove formed about a sealing area and opposed engagement edges along its length; c) the lid member and closure panel being configured such that the longitudinal engagement edges of the closure panel may be slidingly mounted in the engagement tracks on the lower surface of the top wall of the lid member to reclosably seal the drinking aperture when the closure panel is slid along the engagement tracks; d) wherein the post of the closure panel projects upwardly through the post aperture when the closure panel is mounted in the engagement tracks, the post aperture and post thereby cooperating to limit displacement of the closure panel with respect to the lid member; and e) a sealing position of the closure panel being further characterized wherein the sealing ridge about the drinking aperture seats in the sealing groove of the closure panel.

Another specific construction of the inventive lid includes: a) a thermoformed lid member provided with a sidewall and a top wall, i) the sidewall having a mounting groove for removably mounting the lid to the cup, the sidewall defining a crown around a recess with a recess surface in the top wall, the crown defining a height, H, above the recess surface of the top wall; ii) the top wall having an upper surface and a lower surface and defining a drinking aperture at a periphery thereof, the top wall further defining a guideway depending from its lower surface, the top wall also having a post aperture disposed inwardly with respect to the drinking aperture; b) a thermoformed closure panel having an upper surface provided with a post projecting upwardly therefrom and a drinking aperture sealing area; c) the lid member and closure panel being configured such that the closure panel may be slidingly mounted for generally radial displacement in the longitudinal guideway on the lower surface of the top wall to reclosably seal the drinking aperture with its drinking aperture sealing area, wherein the post projects upwardly through the post aperture in the top wall; d) the post aperture and post thereby cooperating to limit radial displacement of the closure panel with respect to the lid member, and e) wherein the post height projects upwardly from the recess surface at most to about the 1.25 H, such that lid stacking occurs free of substantial interference from the post when a plurality of assembled beverage lids of the type defined in elements a-e above are nested in a stack. The reclosable cup lids of the present invention are stackable.

In one form, the lids of the invention are made by thermoforming. Generally speaking, thermoforming is the pressing and/or stretching of heated deformable material into a final shape. In the most basic aspect, thermoforming is the draping of a softened sheet over a shaped mold. In the more detailed aspect, thermoforming is the automatic high speed positioning of a heated sheet having an accurately controlled temperature into a pneumatically actuated forming station whereby the article's shape is defined by the mold, followed by trimming and regrind collection as is well known in the art. Forming techniques other than conventional thermoforming can also be suitable for the manufacture of articles described in the present invention. These include variations such as presoftening the extruded sheet to temperatures below the final melting temperature, cutting flat sections (i.e. blanks) from the sheet, transfer of blanks by gravity or mechanical means into matched molds whereby the blanks are shaped into the article by heat and pressure. Still other alternative arrangements include the use of drape, vacuum, pressure, free blowing, matched die, billow drape, vacuum snap-back, billow vacuum, plug assist vacuum, reverse draw with plug assist, pressure bubble immersion, trapped sheet, slip, diaphragm, twin-sheet cut sheet, twin-sheet rolled forming and suitable combinations of the above. Details are provided in J. L. Throne's book, *Thermoforming*, published in 1987 by Coulthard. Pages 21 through 29 of that book are incorporated herein by reference. Suitable alternate arrangements also include a pillow forming technique which creates a positive air pressure between two heat softened sheets to inflate them against a clamped male/female mold system to produce a hollow product. Metal molds are etched with patterns ranging from fine to coarse in order to simulate a natural or grain like texturized look. Suitable formed articles can be trimmed in line with a cutting die with the trimmings being optionally reused. Other arrangements for productivity enhancements include the simultaneous forming of multiple articles with multiple dies in order to maximize throughput and minimize scrap.

Thermoplastic materials are intended to encompass materials suitable for thermoplastic molding of hot cup lids. A material suitable for the lid is a styrene polymer composition, which may be filled or unfilled. The composition can have enough pigment to provide opacity or near opacity. Other suitable materials include polyolefins such as polyethylenes, polypropylenes and mixtures thereof, polyesters, polyamides, polyacrylates, polysulfones, polyetherketones, polycarbonates, acrylics, polyphenylene sulfides, acetyls, cellulosics, polyether imides, polyphenylene ethers/oxides, styrene maleic anhydride copolymers, styrene acrylonitrile copolymers, polyvinyl chlorides, and engineered resin derivatives thereof. These materials can likewise be filled or unfilled. Fillers for any of the polymeric materials can be any conventional materials, as would be well known to one or ordinary skill in the art.

The lid (both lid member and closure panel) can be thermoformed from a sheet of thermoplastic material. Typically, the thermoplastic sheet from which the lids are made has a caliper of from about 10 to about 20 mils (thousandths of an inch), or from about 14 to about 19 mils. The sheet from which the blanks have been cut out can be collected from regrind material and can be recyclable. Yet further, the sheet from which the blanks have been cut can be made from virgin material. Yet, still further, the sheet material from which the blanks have been cut can be prepared from a mixture of virgin and regrind material.

Articles which are thermoformed should be designed so as to permit the die section to be parted free of the molded articles without undue interference with the surfaces of the articles. The surfaces of such articles generally include a so-called positive "draft" with respect to the direction in which the die sections are moved during parting to insure that there is little or no interference between the molded article and the interior surfaces of the die sections during parting. Interference between the articles and the dies is commonly known as "negative draft". The draft may be thought of as the difference between the upper lateral span of a mold cavity and that span below it. A positive draft allows the pattern to be pulled cleanly from the mold; however, undercuts inherently have a negative draft.

In the present invention, the undercut depth and distance required to secure the closure panel to the domed part of the lid is generally minimized in order to reduce the manufacturing difficulties that can be associated with negative draft. In particular, the engagement tracks can have undercut grooves defined by an inner wall thereof and an outer wall of positive draft, wherein the outer walls of the engagement tracks have an arcuate profile.

The inventors herein have found that in order to make the reclosable cup lid of the present invention, it is necessary to balance the manufacturability of the lid portion with the need to retain the closure panel within the engagement track. That is, in order to function as a resealable closure for a beverage, the closure panel must slide readily from an open to a closed position when inserted into the engagement track. This requires that a well-defined track be present. In reclosable lids prepared from injection molded plastics, the track is generally defined by rails formed in the lid. However, as would be appreciated by one of ordinary skill in the art, it is virtually impossible to form sharp edges in a thermoformed process, such as that from which the reclosable lid of the present invention is manufactured. Sharp corners cannot be readily prepared in thermoforming. Also, the piece must be designed so as to make it removable from the mold without substantial distortion of the piece (e.g., bending or torsioning), which will negatively effect the structural integrity of the piece. To this end, the sharp angles depicted in U.S. Pat. No. 6,824,003 (previously incorporated herein by reference) would be exceedingly difficult to manufacture in a thermoforming process.

The inventors herein have found that in order to make a thermoformed reclosable cup lid, the shape the engagement track (which is defined by an undercut grooves and the total distance of the engagement track) is especially important. If the track design is not kept within certain parameters, it has been found that the thermoformed lid cannot be stripped from the mold without severe distortion of the engagement track to the point that the closure panel cannot be inserted into the track to provide a suitable reclosable cup lid. That is, if the lid must be distorted substantially in order to remove it from the mold, the polymer material that makes up the engagement track will be stretched or distorted such that the engagement track no longer has structural integrity. Such loss of structural integrity will cause the closure panel to not be reliably engaged within the engagement track and/or to allow liquid to leak out of the lid during use.

The engagement tracks of the present invention comprise undercut depths that define undercut grooves, which, in turn, substantially define the engagement tracks. The undercut depth can be from at least about 0.020 to about 0.060 inches or from about 0.025 to 0.050 inches. The inventors herein have found that when the undercut groove is too deep, the engagement track will become distorted when removing the lid from the mold. This is believed to be due to the need to bend or torsion the lid in order to eject it from the mold at, for example, the recess 160 in FIG. 13 because, put simply, the lid will become stuck in the mold recess when it is too deep. The inventors herein have also found that a range of undercut depths is relevant to define an engagement track that is deep enough to result in reliable retention of the closure panel. The undercut depths of the present invention ensure that the slide will not become disengaged from the track and fall into the beverage in use.

Additionally important to the manufacturability of the inventive reclosable cup lid is the ability to insert the closure panel into the engagement track without significant distortion of the engagement tracks, while still maintaining the integrity of the engagement tracks. The closure panel must be quickly and easily insertable into the engagement track during high speed assembly without distortion of the engagement tracks such that the closure panel will be retained in the track during use. To this end, the inventors herein have found that a scallop (or fluting) provides a lid structure that is particularly suitable for the reclosable lid herein. This scalloped orientation is, for example, pictured in FIG. 12 herein. The scallops can range have end-to-end radii from about 0.125 to about 0.30 inches. Since the total number of scallops defines the length of the engagement track, when the radii are smaller, more scallops will be present; when the radii are larger, fewer scallops will be present. The engagement tracks are separated by a distance. The tracks are generally parallel to each other. The undercut depth and the scalloping cooperate to provide the engagement tracks in which the closure panel operates.

It has also been found that insertion and fit of the closure panel can be improved by beveling the elongated edges of the closure panel. By beveling these edges, the closure panel requires less force to insert into the engagement track. Further, a beveled edge allows the closure to slide (or slip) into the engagement tracks without noticeable stress being placed upon either the closure panel itself or the engagement tracks. The angles can be as discussed previously.

In some aspects, the arm of the engagement tracks in which the closure panel resides is not tapered at a free end. Still further, the engagement tracks do not comprise a pair of C-shaped rails. Such C-shaped rails are disclosed in U.S. Pat. No. 6,824,003 (previously incorporated by reference herein). The '003 patent states that when a C-shaped rail is tapered at a free end, snapping of the closure member into the lid portion is facilitated. The inventors herein believe that, even with inclusion of the tapered ends, the design of the '003 patent would result in significant distortion of the structure of the C-shaped rails when inserting the closure panel into the lid of the '003 patent. Further, it is believed that it would be exceedingly difficult to prepare the lid pictured in the '003 patent with use of thermoforming techniques due to the sharp edges in the design. As noted in above, such sharp edges cannot be reasonably applied in manufacturing because the piece would be difficult to remove from the mold after thermoforming.

In contrast to the track design disclosed in the '003 patent, the scalloped design of the engagement tracks of the present invention allows the lid member to be easily removed from the mold after thermoforming with little or no distortion of the engagement tracks. Further, in the present invention, the scalloped configuration of the engagement tracks allows the closure panel to be securably held in the engagement tracks so as to provide a reclosable seal in the finished cup lid. The inclusion of angled outer edges on the closure panel can further improve the ability to assemble the lid to provide a reliable seal in a two-piece reclosable and disposable cup lid.

The reclosable lid of the present invention is assembled by applying a bending force to the lid such that the distance between the generally parallel engagement tracks is widened. This widening allows the closure panel to be slidingly engaged into the engagement tracks. The post is oriented so that it projects upwardly through the post aperture.

In contrast to the '003 patent, the closure panel is not snapped into the engagement tracks. Further, the lid member itself is bent to insert the closure panel into the engagement tracks in the present invention, whereas in the '003 patent, the engagement tracks, i.e., the C-shaped rails, themselves are bent to snap the panel therein into place.

The invention also provides a method of making a reclosable and disposable lid for a cup comprising: providing a lid member prepared from a thermoformable material, wherein the lid member comprises: providing a thermoformed closure panel having a post projecting upwardly from the closure panel, wherein the closure panel is configured to slidably fit within the engagement tracks, applying a bending force to the lid member to widen the distance between the engagement tracks; inserting the closure panel into the engagement tracks so that the post is disposed upwardly through the post aperture, wherein the insertion is conducted while the lid member is undergoing bending; and relieving the bending force after insertion of the closure panel into the tracks. The lid member comprises: a sidewall suitable for engagement with a cup brim; and a top wall comprising: a drinking aperture at a periphery of the top wall, a pair of generally parallel engagement tracks separated by a distance, wherein the engagement tracks are disposed on a lower portion of the top wall portion, wherein each of the tracks comprise a scalloped configuration and an undercut depth, and wherein the scalloped configuration and undercut depth cooperate to provide the engagement tracks; and a post aperture disposed toward a center of the lid member.

In regards to the manufacturability of the reclosable lid of the present invention, the mechanical stripping action of the stripper plate must be timed closely with the air eject function. Firing the stripper plate too soon or too late in conjunction with the air eject blast will tear the track and distort the lid making it unusable.

The reclosable and disposable cup lid of the present invention can be sized to fit any cup upon which cup lids are normally used. The reclosable and disposable cup lid of the present invention is especially suited for use with hot beverages.

Turning now to FIGS. 1 through 13, there is shown a reclosable, thermoformed beverage lid 10 for a cup 100, the lid being configured in accordance with the present invention (including variations of the various features). The inventive lid includes a thermoformed domed member 12 and an closure panel 70, the closure panel 70 being undermounted on the domed member 12 as will be further explained.

Lid member 12 includes a peripheral sidewall 14 depending from a disc-shaped top wall 16. Sidewall 14 and top wall 16 of domed member 12 define an interior dome cavity 18. Top wall 16 further includes an inner surface 20 when viewed from interior dome cavity 18 and an outer surface 22 opposite inner surface 20. As will be appreciated from viewing the figures, top wall 16 is recessed with respect to sidewall 14 because an upper end of sidewall 14 forms a crown 24. Crown 24 is rounded at its top so as to enhance ergonomics of domed member 12 and make it more comfortable for contact by a user's lips. For example, about a full 0.050 inch radius, R1, can be used for crown 24. A height of the crown 24 is specified by H as a distance the crown extends above outer surface 22 of domed member 12. Further details of crown 24 will be described below in connection with additional features of lid 10.

Sidewall 14 further includes a generally annular skirt portion 26 depending therefrom. Skirt portion 26 includes an annular sealing groove 28 formed adjacent a distal end of sidewall 14 and a generally annular flared trim 30 depending from annular sealing groove 28. Annular sealing groove 28 is configured to engage a brim 104 of cup 100 and form a seal therewith, as is known in the art and shown by way of reference in FIG. 10. Thus, annular sealing groove 28 provides one means to prevent leakage of contents from cup 100 when lid 10 is secured thereto. Generally annular flared trim 30 provides a gripping surface for a user to remove or apply lid 10 to cup 100.

Figure 11:
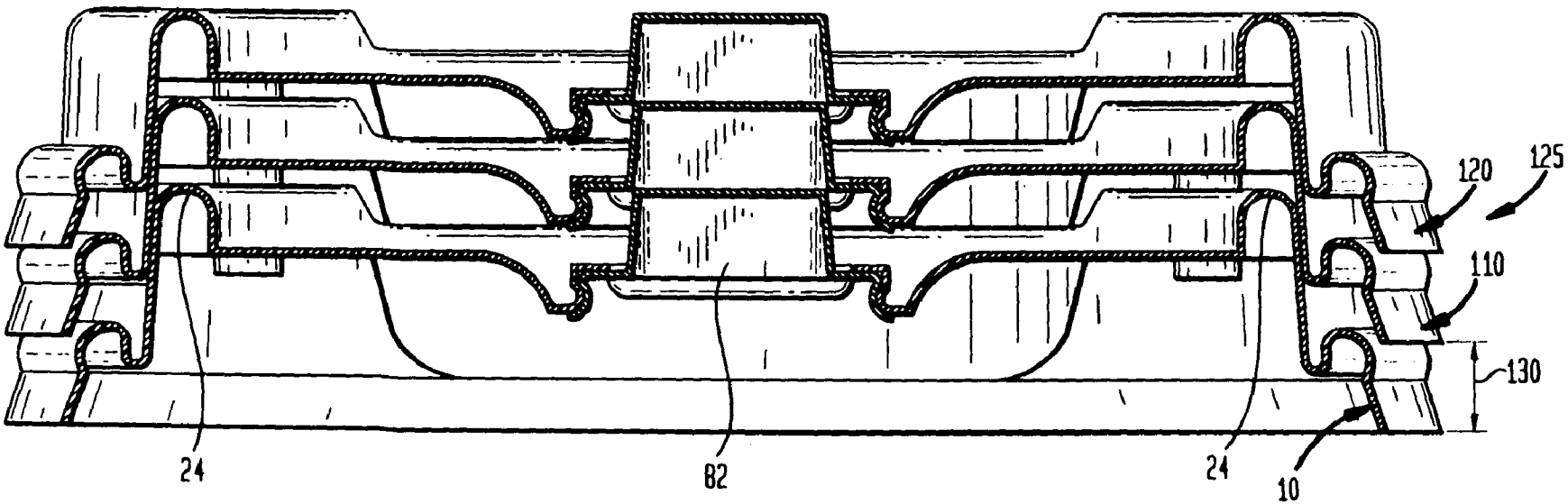
FIG. 11 is a side view showing lid-on-lid nested stacking according to the present invention.

Sidewall 14 additionally includes stacking notches 32 formed in sidewall 14 and crown 24. Stacking notches 32 facilitate stacking individual lids 10 with each other and to prevent lids 10 from sticking together when being unstacked. Four stacking notches 32 are shown for each lid 10; however this number is not critical and may be changed according to manufacturing needs or end use. An example of lid-on-lid stacking is shown in FIG. 11.

A lip recess 34 is also formed in a portion of sidewall 14 to visually direct a user to a drinking aperture 38 of the lid 10 as well as provide a thinner, more comfortable drinking surface on sidewall 14. Lip recess 34 as shown, shaped to accommodate a lower lip of a consumer. Specifically, an edge 36 of lip recess 34 defines the configuration of lip recess 34. In a specific form, edge 36 has a generally straight base portion 36*a* that connects with a generally outwardly curved end segment 36*b* at each end. Lip recess 34 is positioned radially inward from a surface of sidewall 14. Although lip recess 34 is shown positioned on both crown 24 and sidewall 14, lip recess 34 can be limited to either crown 24 or sidewall 14. Further, an overall height H of crown 25 is reduced at a location of lip recess 34 to facilitate drinking from lid 10 without interference from crown 24. The shape and configuration of lip recess 34 can be varied to conform to numerous design parameters. Similarly, the degree of recess 34 and crown height H thereat can vary. The crown has a gapped portion 34*a* at lip portion 34 of lower height, H'.

Top wall 16 includes drinking aperture 38 and further includes a post aperture 40. Drinking aperture 38 is positioned adjacent crown 24 and specifically can be positioned within an area defined by lip recess 34. Post aperture 40 is positioned in a substantially center of top wall 16 and radially inward from drinking aperture 38. Even more specifically, post aperture 40 is in diametric alignment with drinking aperture 38. A male sealing ridge 42 surrounds and corresponds in shape to drinking aperture 38, but is greater in overall circumference than drinking aperture 38. By way of example, drinking aperture 38 can be about 0.0438 inch in width and about 0.250 inch in length, wherein length corresponds to diametrical direction of top wall 16. Sealing ridge 42 is oriented to project toward interior dome cavity 18 by a distance of about 0.04 inches and have an arcuate radius of about 0.04 inches as well.

Post aperture 40 is substantially rectangular in shape and defines a "CLOSE" stop limit edge 44 and an "OPEN" stop limit edge 46 in directions toward and away from drinking aperture 38, respectively. CLOSE stop limit edge 44 can be about 1.185 inch from a center of drinking aperture 38, and an overall length of post aperture 40 can be about 0.678 inch. Each of drinking aperture 38 and post aperture 40 are die or punch cut during a manufacturing process of lid 10 as is known in the art.

A pair of engagement tracks 48 is formed on inner surface 20 of top wall 16 to traverse substantially an entire diameter of top wall 16 along the direction of drinking aperture 38 and post aperture 40. Engagement tracks 48 depend from inner surface 20 of top wall 16 and define respective corresponding longitudinal undercut grooves 62 in each of engagement tracks 48, respectively, and inner surface 20 of top wall 16. Engagement tracks 48 present a different profile when viewed from inner surface 20 or outer surface 22 of top wall 16 as follows.

When viewed from outer surface 22 of top wall 16, engagement tracks 48 are positioned so as to straddle aligned drinking aperture 36 and post aperture 38 by a distance sufficient to define a land area 50 therebetween. Land area 50 is visually distinguishable from a remainder of top wall 16, and is therefore suitable for receiving indicia or the like thereon. Formation of engagement tracks 48 is such that substantially planar outer surface 22 includes a smooth arcuate transition surface 52 at the outer wall of the track terminating in a flat bottomed surface 54 having a channel 56 opposing transition surface 52. Channel 56 is bounded by a substantially vertical wall 58 terminating at land area 50 of top wall 16. Thus, when viewed from outer surface 22, engagement tracks 48 appear to have channel 56 tucked beneath longitudinal undercut edges of land area 50 in top wall 16.

When viewed from dome cavity 18, channel 56 defines a gripping surface or overhang 60 adapted for receiving closure panel 70 and undercut groove 62 is formed between gripping surface 60 and inner surface 20 of land area 50. Arcuate transition surface 52 has a radius of curvature of, for example, about 0.25 inches and defines, about a 45° angle with respect to flat bottomed surface 54. Flat bottomed surface 54 can be, for example, about 0.062 inches wide along a length of each slide track 48. An inside radius of curvature of channel 56 can be, for example, about 0.043 inches. Undercut groove 62 has undercut depth of, for example, from about 0.02 to about 0.06 inches.

Undercut depth 65 is the distance from the outermost projection of portion 60 to the bottom of groove 62 at 59 as is been seen in FIG. 7A.

Formation of engagement tracks 48 in top wall 16 in this manner is found to allow molding material to deform into a retention area of engagement tracks 48 and minimize thinning of the thermoplastic material. To prevent opposing ends of engagement tracks 48 from being thinner than desired, a vacuum crack can be provided in the mold, which reduces thinning in extreme corners of ends of engagement tracks 48. Optionally, it is possible to machine a larger radius in the corner which will define an ellipse.

Figure 10:
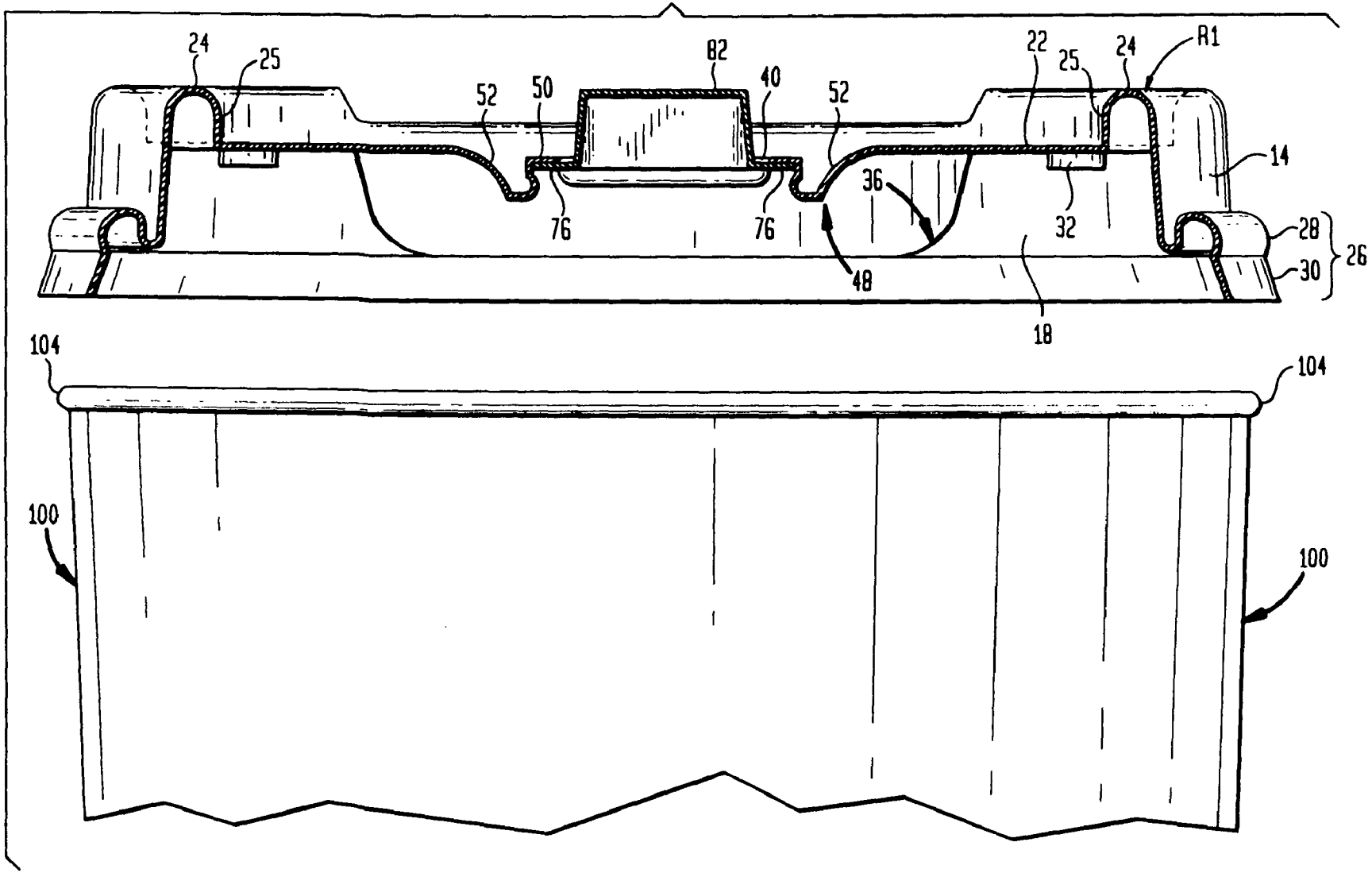
FIG. 10 is a partial sectional view of an alternative interconnection of a dome and closure panel wherein the closure panel is essentially planar except for the post.

A second part of lid 10 is closure panel 70. Closure panel 70 is an elongated rectangular member having an upper surface 72, a lower surface 74, opposed longitudinal engagement edges 76 (see FIG. 6B) and opposed ends including a closure end 78 and a non-closure end 80. A post 82 projects from upper surface 72 of closure panel 70 a spaced distance from a sealing area 84. Sealing area 84 is formed at closure end 78 of closure panel 70 and includes a female groove 86 corresponding in shape and size to drink aperture sealing ridge 42 of top wall 16. Opposed longitudinal edges 76 of closure panel 70 are formed either with a particular engaging shape (FIGS. 5A, 5B, 6A, 6B and 7), or, optionally, as a substantially planar termination of planar closure panel 70 (FIG. 10).

Referring especially to FIGS. 5A and 5B, opposed longitudinal edges 76 are each substantially in the shape of the letter "S" with one side being reversed with respect to an opposing shape. Each of opposed longitudinal edges 76 includes an upper outwardly projecting insertion lip 88 transitioning to a lower inwardly arcuate engagement portion 90. Insertion lip 88 is sized to fit within undercut groove 62 of domed member 12. Further, insertion lip 88 is sized to be slidingly received within undercut groove 62 such that a slight friction is obtained therebetween, but is preferably not exactly the same shape as the undercut groove 62, thereby avoiding suction or too much friction between the undercut groove 62 and insertion lip 88 which would inhibit sliding motion. In this respect, there is preferably a slight gap 63 between the closure panel and undercut groove 62 as seen in FIG. 7. Lower inwardly arcuate engagement portion 90 is shaped to at least partially surround a corresponding gripping surface 60 of engagement tracks 48. By at least partially surrounding gripping surface 60 with arcuate engagement portion 90, improved leak prevention is obtained when cup 100 is tipped or overturned with lid 10 secured thereon and/or for keeping heat within cup 100 when lid 10 is applied. This is due to an increased surface area and hence, increased surface contact between domed portion 12 and closure panel 70 as compared with known lids.

Dimensions of closure panel 70 are designed to correspond to those of engagement tracks 48 in order to provide a substantially fluid tight engagement therebetween, yet allow sliding movement of closure panel 70 within engagement tracks 48. Accordingly, insertion lip 88 can have an inner radius for example, of about 0.010, outwardly arcuate engagement portion can have an outer radius, for example, of about 0.057 inches, and a distance between an inner surface of insertion lip 88 and inner surface of arcuate engagement portion 90 as viewed from an inner surface of closure panel 70 can be, for example, about 0.060 inches.

Opposing closure end 78 and non-closure end 80 may be formed with the same outwardly arcuate insertion lip 88 transitioning to lower inwardly arcuate engagement portion 90, or, alternatively, terminate in the same plane with upper surface 72 of closure panel 70. In the case where ends 78, 80 are formed with outwardly arcuate insertion lip 88 and lower inwardly arcuate engagement portion 90, the formations may either be continuous around closure panel 70 or broken at one or more corners of closure panel 70.

Closure panel 70 also includes a vent hole 92 formed therein. Vent hole 92 can be positioned between sealing area 84 and post 82 such that vent hole 92 is exposed when drinking aperture 38 is open. Vent hole 92 is adapted to ensure the continuous flow of the container contents though drinking aperture 38 while venting the container. Alternatively, vent hole 92 can be placed elsewhere in lid 10. In addition, post 82 and sealing area 84 are spaced apart a distance defined by drinking aperture 38 and stop limit close 44 of post aperture 40.

As can be seen from the figures, closure panel 70 is of a length of from about one-half to about three-fourths the length of a diameter of the top wall 16. The length of the closure panel can be about two-thirds the length of the diameter of the top wall 16. Stated another way, the area of the closure panel can be from about 5 to 25 percent of the area of the top wall 16 or from about 10 to about 45 percent of the area of the top wall 16, but not more than about 50 percent.

It is noted closure panel 70 has an aspect ratio (L/W, FIG. 4) of at least about 1.5, at least about 2, or at least about 3.

Figure 9:
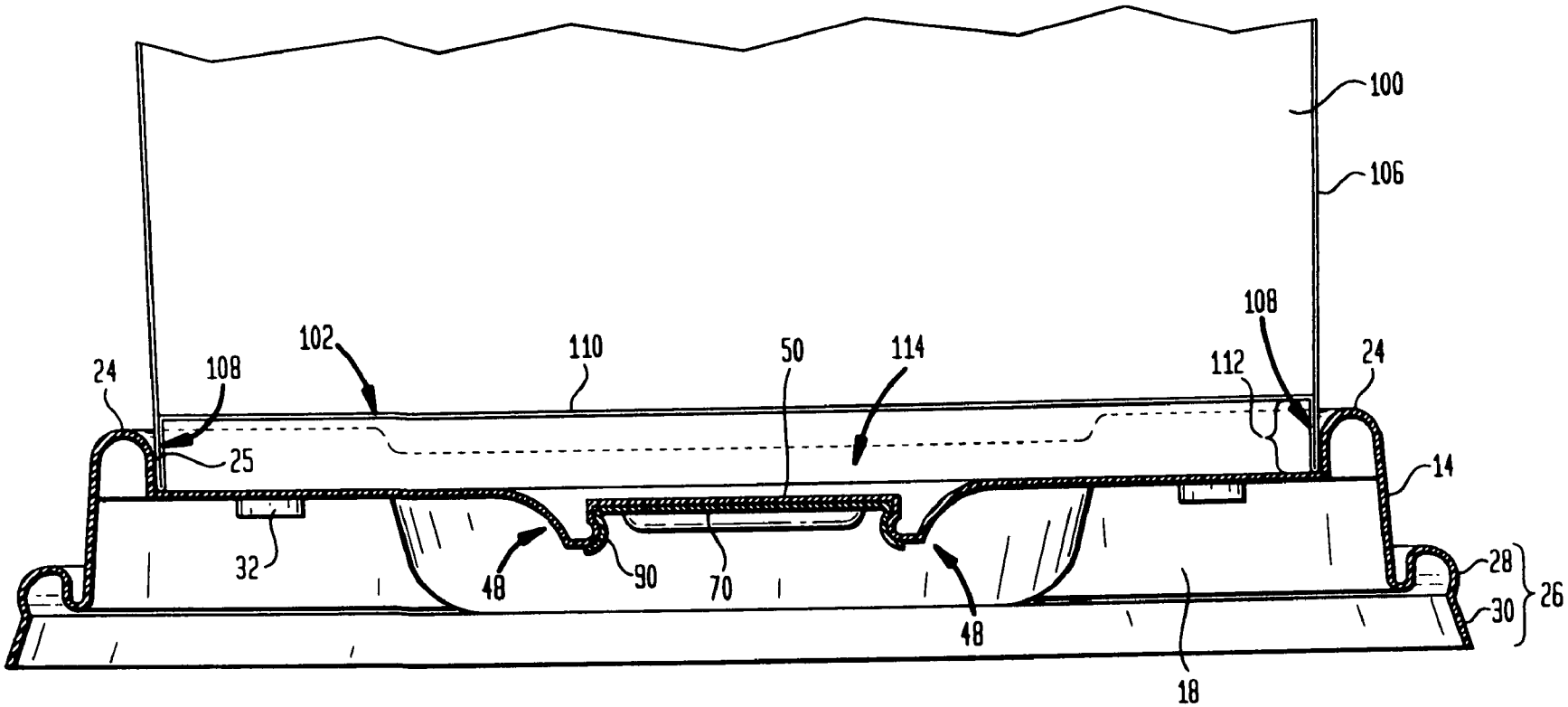
FIG. 9 is a side sectional view illustrating cup on lid stacking according to the present invention as well as the profile of the lid along line 9-9 of FIG. 2.

In FIG. 9, there is illustrated cup-on-lid stacking as will be easily achieved with the lid 10 of the present invention. Cup 100 includes a base end 102, an upper brim 104, and sidewalls 106 connecting base end 102 to brim 104. Base end 102 includes an annular support surface 108 and a cup bottom 110 recessed within annular support surface 108 to define a wall height 112 between annular support surface 108 and cup bottom 110. Limits of annular support surface 108, cup bottom 110, and wall height 112 define an open area 114 therein. Such a construction of a cup base end 102 is well known in the art. Annular support surface 108 seats on lid 10 against and/or within crown 24, while post 82 easily fits in open area 114. Stacking of cup-on-lid without interference from post 82 is therefore achieved in connection with two-piece lid 10 in a manner not previously possible.

As will be appreciated from FIG. 5A, the height, H", of post 82 can be only slightly higher then the height, H, of crown 24 above surface 22. This feature allows for cup-on-lid stacking as noted above as well as lid-to-lid stacking discussed further herein.

In operation, shaped longitudinal edges 76 of closure panel 70 are fit to slidably engage with longitudinal undercut grooves 62, and gripping surfaces 60, such as at an assembly location and prior to use by a consumer. Upon assembly, post 82 protrudes through post aperture 40 and drinking aperture 38 is either open or closed according to a position of closure panel 70. At a point of consumer use, post 82 is movable within post aperture 40 between open stop limit edge 46 and close stop limit edge 44 in order to open or close drinking aperture 38, respectively. Urging post 82 to close stop limit 44 (toward drinking aperture 38) will cause male sealing ridge 42 of top wall 16 to engage with female groove 86 of closure panel 70, causing a snap fit closure therebetween. Urging post 82 to open stop limit 46 (away from drinking aperture 38) will disengage male sealing ridge 42 from female groove 86, releasing the snap fit closure between those parts and thereby opening drinking aperture 38. Stop limits 44 and 46 will limit movement of post 82 and hence closure panel 70 to positions which encompass fully closed and fully opened drinking aperture. Any position in between outermost limits of motion are also available, and will be maintained due to slight friction between longitudinal edge shapes of closure panel 70 and slide track 50 configuration of top wall 16.

Sealing area 84 of closure panel 70 which contains female groove 86 does not protrude through drinking aperture 38 but instead defines a surface area 94 within female groove 86 and covers a larger area than an area of drinking aperture 38. Because closure panel 70 has surface area 94 completely covering drinking aperture 38 from inner surface 20 of top wall 16, inversion or tipping of a lidded and closed container will cause the contents of the container to further force closure panel 70 and thus surface 94 against drinking aperture 38. Accordingly, having drinking aperture 38 sealed from an interior of lid 10 will prevent leaking better than a closure from an upper surface of lid 10, thus enhancing sealing of the container contents.

While a closure panel with shaped (for example, chamfered) edges is preferred, a substantially planar closure panel with flat engagement edges 76 will likewise be suitable as shown schematically in FIG. 10. FIG. 10 is a view in section similar to FIG. 5A.

Crown 24 of sidewall 14 is specifically provided to prevent a stacked cup 100 from sliding off of lid 10. In particular, crown 24 is of a height and dimension such that a base end 102 of cup 100 will fit against an inner wall surface 25 of crown 24. Further, crown 24 has a height H substantially corresponding to a height of post 82 and because post 82 is positioned away from crown 24, stacking of cups 100 and lids 10 is unaffected by post 82 because post 82 will fit within open area 114 of known containers and cups when stacking occurs.

Referring to FIG. 11, it is seen that the lids of the invention 10, 110, 120 can be readily stacked in a nested stack 125 at a separation distance 130 of, for example, about 0.180" because the post does not protrude substantially above crown 24.

Although shapes of drinking aperture 38, male sealing ridge 42 and female groove 86 are shown to be generally oval, it will be appreciated that any suitable shape will accomplish the intended function of sealing drinking aperture 38 as long as male sealing ridge 420 and female groove 86 correspond in shape and dimension to achieve a snap fit therebetween. For example, alternative shapes of drinking aperture 38 may include, but not be limited to, circular, square, or rectangular.

Although described separately, lid member 12, sidewall 14, and skirt portion 26 are suitably formed as a one-piece ensemble in a thermoforming process. In an effort to clarify the features of the present invention, various features have been discussed in conjunction with the formation of a single lid; however, it will be appreciated by those skilled in the art that a plurality of lids may be simultaneously formed from a single sheet of thermoplastic material utilizing known manufacturing methods.

Generally, lid 10 has a wall caliper of from about 10 to about 20 mils, or from about 14 to about 18 mils.

Closure panel 70 can be formed from the same material used to form the remainder of lid 10. However, closure panel 70 can be formed from other lightweight materials.

Figure 13:
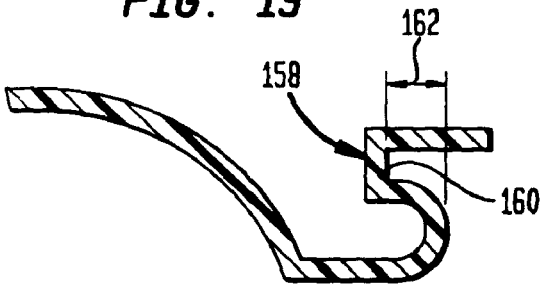
FIG. 13 is a profile of a slide track of FIG. 12 at maximum inward projection.

Referring to FIGS. 12 and 13, there is shown another lid 150 configured in accordance with the present invention. Lid 150 has a closure panel 152 generally as described above as well as dome 154 with a pair of opposed side tracks 156, 158. Side tracks 156 and 158 have undercut grooves as noted in connection with the embodiment of FIG. 1; however, the engagement tracks can have a scalloped geometry along the longitudinal direction as shown in FIG. 12. The scallops facilitate product stripping from the mold and may have a radius of curvature of from about 0.125 to about 0.30 inches or about 0.15 to 0.25 inches. Other possible configurations for the scalloped lids are set forth in the text herein. The scalloped geometry also facilitates a deeper undercut groove as is seen in FIG. 13, which is a view of a portion of the profile of the dome along lines 13-13 which is an area maximum inward projection.

It is seen in FIG. 13 that undercut groove 160 has an undercut depth 162 from about 30 to about 50 mils or so; a maximum depth that is intermittent with lesser depths. Other possible configurations for the undercut depth are set forth herein.

Figure 14:
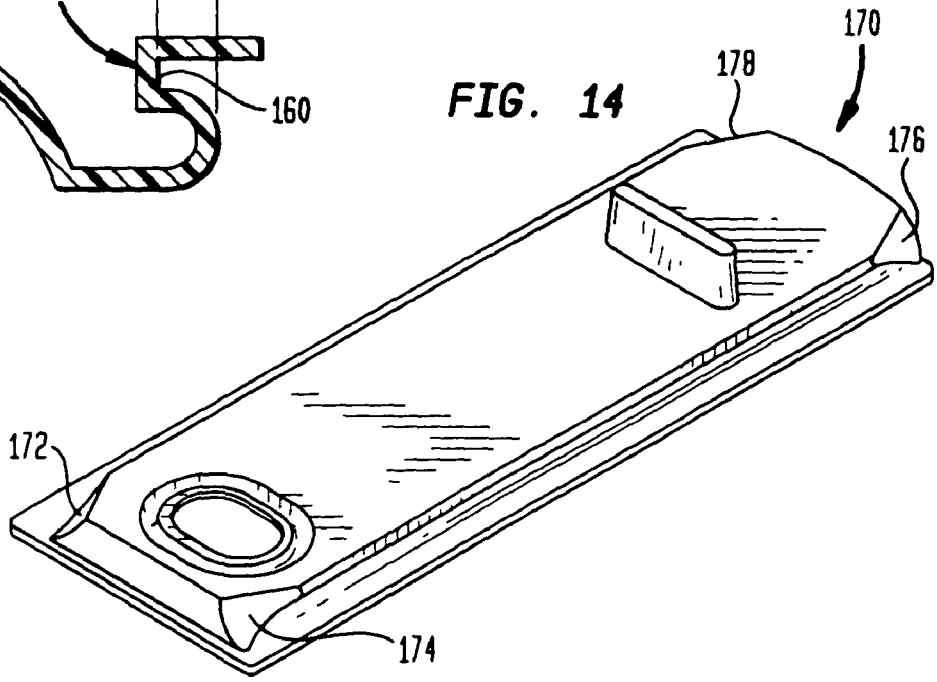
FIG. 14 is a view in perspective of an alternate configuration of the slide panel of the inventive lid having beveled (chamfered) corners.
Figure 15:
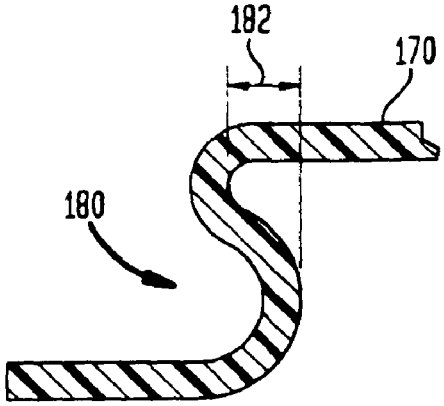
FIG. 15 is a partial profile of the closure panel of FIG. 14.

Alternate configurations are also available for closure panels of the inventive lid. Panel 170, for example, shown in FIG. 14, may be used in the engagement tracks 156, 158 of FIG. 12. Panel 170 is similar to the closure panel shown in FIG. 1; however, panel 170 has a plurality of beveled corners 172, 174, 176, 178 as well as generally square ends. So also, the edges may be provided with a deeper undercut as shown in FIG. 15. In FIG. 15, longitudinal edge 180 of panel 170 is provided with an undercut depth 182 of about 40 mils or so.

Figure 16:
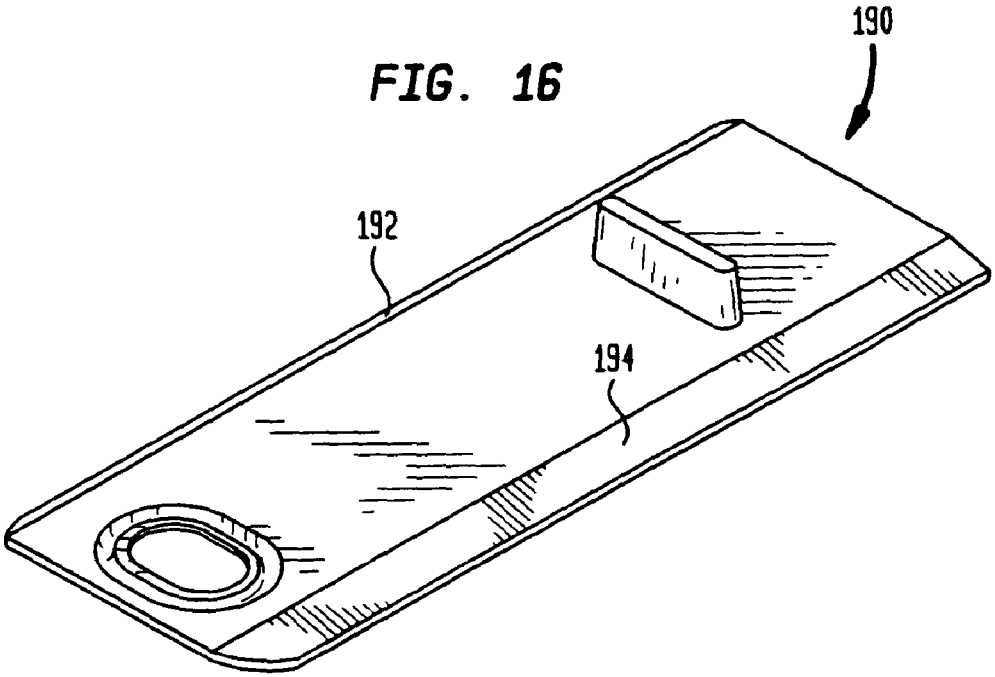
FIG. 16 is a view in perspective of yet another slide panel used in connection with the lid of the present invention, wherein the slide panel has a generally chamfered shape.
Figure 17:
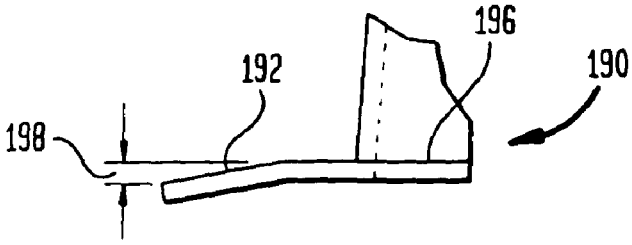
FIG. 17 is a partial end view of the closure panel of FIG. 15.

Referring to FIGS. 16 and 17, there is shown still yet another closure panel 190 which is generally similar to the closure panels described above, except that panel 190 has chamfered edges 192, 194 which are perhaps better appreciated by reference to FIG. 17 which is a partial end view of panel 190.

Panel 190 has an upper medial surface 196 which changes direction downwardly at a chamfer angle 198 which may be any suitable angle, for example about 10 degrees or so being suitable.

Figure 18:
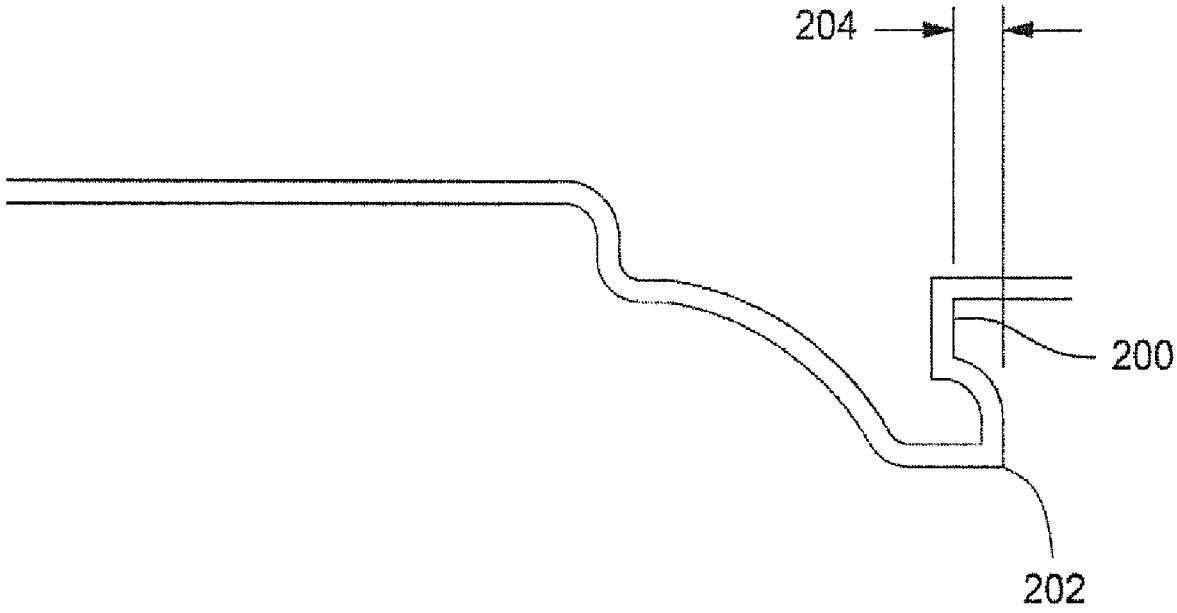
FIG. 18 is a detail showing a further profile of an engagement track.

FIG. 18 shows a further embodiment of the present invention wherein the arm is shaped like a modified "5" with a generally squared-off corner 202. As with the other Figures discussed herein, 200 is the undercut groove that substantially defines an engagement track and 204 is the undercut depth.

While the invention has been described in connection with numerous features, modifications to those examples within the spirit and scope of the invention will be readily apparent to those of skill in the art. In view of the foregoing discussion, relevant knowledge in the art and references discussed above in connection with the Background and Detailed Description, the disclosures of which are all incorporated herein by reference, further description is deemed unnecessary.

What is claimed is:

1. A reclosable and disposable lid for a cup comprising:
- a thermoformed lid member comprising:
  - a sidewall suitable for engagement with a cup brim; and
  - a top wall comprising:
    - a drinking aperture at a periphery of the top wall,
    - a pair of generally parallel engagement tracks separated from each other by a distance, wherein the tracks are disposed in a longitudinal direction on a lower portion of the top wall portion, wherein each of the tracks comprises a scalloped configuration and an undercut groove; and
    - a post aperture disposed toward a center of the lid; and
- a thermoformed closure panel having a post projecting upwardly from the panel, wherein the panel is configured to slidably fit within the engagement tracks upon the application of a bending force to the lid member, wherein the lid is reclosable and disposable.

2. The lid of claim 1, wherein the engagement tracks substantially span the lower surface of the lid member.

3. The lid of claim 1, wherein the engagement tracks do not comprise C-shaped rails.

4. The lid of claim 1, wherein the closure panel is not snap fittable into the engagement tracks.

5. The lid of claim 1, wherein the closure panel is insertable in the engagement tracks by application of a bending force to the lid member so as to widen the distance between the tracks and placing the closure panel into the tracks so that the post projects upwardly through the post aperture.

6. The lid of claim 1, wherein the closure panel has chamfered longitudinal edges of from about 5 to about 15 degrees with respect to an upper surface of the closure panel.

7. The lid of claim 1, wherein the closure panel is insertable into the engagement tracks with a chamfered side facing a lower portion of the lid member.

8. The lid of claim 1, wherein each of the engagement tracks has an undercut depth of from about 0.02 to about 0.06 inches.

9. The lid of claim 1, wherein a length of the closure panel has a length of from about ½ to about ¾ the length of a diameter of the lid member.

10. The lid of claim 1, wherein the area of the closure panel is not more than about 30% of the total area of the top wall.

11. The lid of claim 1, wherein the closure panel has an aspect ratio of at least about 1.5.

12. The lid of claim 1, wherein the upper surface of the top wall defines a recess with a recess surface and a crown of height, H, above the recess surface thereabout, the recess and crown being adapted to receive the bottom of a cup, whereby a plurality of lidded cups are securely stackable with each other.

13. The lid of claim 12, wherein the post projects upwardly from the surface of the recess at most about 1.25 H and is disposed inwardly with respect thereto when the closure panel is secured in the engagement tracks.

14. The lid of claim 12, wherein the crown has a gapped portion of lower height above the recess surface radially aligned with the drinking aperture thereby providing a stackable lid.

15. The lid of claim 14, wherein the gapped portion has a height of from about 0.75H to about 0.95H above the recess surface.

16. The lid of claim 1, wherein the closure panel comprises a vent hole.

17. A lid for a cup, comprising:

a generally planar portion;

a pair of generally parallel engagement tracks on a lower portion of the generally planar portion, wherein each track comprises a scalloped configuration and an undercut groove;

a post aperture disposed toward a center of the generally planar portion; and a thermoformed closure panel having a post projecting from the panel through the post aperture, wherein the panel is slidably disposed within the engagement tracks.

18. The lid in claim 17, wherein the closure panel has chamfered longitudinal edges that are chamfered at an angle of from about 5 to about 15 degrees with respect to an upper surface of the closure panel.

* * * * *